US007510183B2

(12) United States Patent
Edwards et al.

(10) Patent No.: US 7,510,183 B2
(45) Date of Patent: Mar. 31, 2009

(54) NOTE FACING APPARATUS FOR HIGH SPEED PROCESSING

(75) Inventors: Jerry Edwards, North Richland Hills, TX (US); Kirk Kaaz, Copell, TX (US)

(73) Assignee: De La Ru Holdings, PLC, Irving, TX (US)

( * ) Notice: Subject to any disclaimer, the term of this patent is extended or adjusted under 35 U.S.C. 154(b) by 196 days.

(21) Appl. No.: 11/562,267

(22) Filed: Nov. 21, 2006

(65) Prior Publication Data

US 2008/0116628 A1 May 22, 2008

(51) Int. Cl.
*B65H 29/00* (2006.01)

(52) U.S. Cl. ..... 271/186; 271/187; 271/65; 271/227; 198/471

(58) Field of Classification Search ..... 271/227, 271/65, 186, 187; 198/471
See application file for complete search history.

(56) References Cited

U.S. PATENT DOCUMENTS

| | | | | | |
|---|---|---|---|---|---|
| 3,622,151 | A * | 11/1971 | Range et al. | 406/87 |
| 4,019,435 | A * | 4/1977 | Davis | 101/232 |
| 4,968,419 | A | 11/1990 | Karalus et al. | |
| 5,451,040 | A * | 9/1995 | Crabtree | 271/10.11 |
| 5,464,099 | A * | 11/1995 | Stevens et al. | 209/3.1 |
| 5,535,997 | A * | 7/1996 | Croyle et al. | 271/12 |
| 6,044,760 | A * | 4/2000 | Kruger | 101/232 |
| 6,409,008 | B1 * | 6/2002 | Newsome | 198/403 |
| 6,460,705 | B1 * | 10/2002 | Hallowell | 209/534 |
| 6,626,103 | B2 * | 9/2003 | Neumann | 101/230 |
| 6,726,199 | B2 * | 4/2004 | Ina et al. | 271/65 |
| 6,796,557 | B2 * | 9/2004 | Watanabe et al. | 271/176 |
| 2001/0028145 | A1 * | 10/2001 | Fukatsu et al. | 271/186 |
| 2003/0025266 | A1 | 2/2003 | Stevens | |
| 2006/0181003 | A1 * | 8/2006 | Agata | 271/186 |

FOREIGN PATENT DOCUMENTS

| | | | |
|---|---|---|---|
| JP | 57189949 | A * | 11/1982 |
| JP | 03003857 | A * | 1/1991 |

* cited by examiner

*Primary Examiner*—Patrick H Mackey
*Assistant Examiner*—Prasad V Gokhale
(74) *Attorney, Agent, or Firm*—Carstens & Cahoon LLP

(57) ABSTRACT

The present invention provides an apparatus for facing documents during high speed processing. The present invention employs at least one sensor to scan the documents individually as they are fed sequentially through a processing machine. The sensor determines the direction the documents are facing. Depending on the direction the documents are facing, a path selector directs the documents to one of two equal length paths within the processing machine. If a document is facing up, the path selector directs the document along a first path that leads directly to a collection point. If a document is facing down, the path selector directs the document along a second path that includes a twisted conveyor belt which turns the document about the longitudinal axis to face up. The second path meets with the first path, wherein the conveyor belt reinserts the faced documents back into the same sequential position that the document was in relative to the other documents before being diverted by the path selector.

8 Claims, 5 Drawing Sheets

NOTE FACING APPARATUS FOR HIGH SPEED PROCESSING

BACKGROUND OF THE INVENTION

1. Technical Field

The present invention relates generally to currency processing machines, and more specifically to a method for facing notes during high speed currency processing to ensure all notes of a given denomination are facing the same direction when bundled.

2. Description of Related Art

Automated, high-volume currency processing is a growing international industry affecting numerous aspects of the distribution, collection, and accounting of paper currency. Currency processing presents unique labor task issues that are intertwined with security considerations. Currency processing requires numerous individual tasks, for example: the collection of single notes by a cashier or bank teller, the accounting of individual commercial deposits or bank teller pay-in accounts, the assimilation and shipment of individual deposits or accounts to a central processing facility, the handling and accounting of a currency shipment after it arrives at a processing facility, and the processing of individual accounts through automated processing machines. Any step in the process that can be automated, thereby eliminating the need for a human labor task, saves both the labor requirements for processing currency and increases the security of the entire process. Security is increased when instituting automated processes by eliminating opportunities for theft, inadvertent loss, or mishandling of currency and increasing accounting accuracy.

A highly automated, high-volume processing system is essential to numerous levels of currency distribution and collection networks. Several designs of high-volume processing machines are available in the prior art and used by such varied interests as national central banks, independent currency transporting companies, currency printing facilities, and individual banks. In general, currency processing machines utilize a conveyer system which transports individual notes past a series of detectors. By way of example, a note may be passed through a series of electrical transducers designed to measure the note's width, length, and thickness. The next set of sensors could be optical sensors recording the note's color patterns or serial number. Detectors can likewise be used to detect specific magnetic or other physical characteristics of individual notes.

High volume currency processing machines typically pull individual notes from a stack of currency through a mechanical conveyer past several different detectors in order to facilitate the sorting of the individual notes and the accumulation of data regarding each note fed through the machine. For example, a currency processing machine can perform the simple tasks of processing a stack of currency in order to ensure that it is all of one denomination with proper fitness characteristics while simultaneously counting the stack to confirm a previous accounting. A slightly more complex task of separating a stack of currency into individual denominations while simultaneously counting the currency can be accomplished as well.

On the more complex end of prior art currency processing machines, a stack of currency consisting of various denominations can be fed into the machine for a processing that results in the separation of each denomination, a rejection of any currency that does not meet fitness specifications, the identification of counterfeit bills, and the tracking of individual notes by serial number.

Current high-volume currency processing machines are loaded with one single stack of currency, identified to a single set of accounting parameters, before executing the sort process. For example, a stack of currency associated with a specific commercial deposit at a bank may be loaded at the beginning of the currency processing cycle. The currency is then fed into the currency processing machine and sorted based on the needs of the customer. Typically, notes are stacked according to denomination. In the U.S., for example, currency processing machines handle six primary denominations: $1, $5, $10, $20, $50, and $100 dollar bills. Though other less frequent denominations exist (e.g., $2), they are so few in number that they can be collected in a reject bin. In the U.S. approximately 80% of the notes handled by currency processors are $20 bills.

The goal of processing large batches of currency is to produce stacks that are organized according to denomination, with all of the notes in each stacked faced in the same direction. Currently, this process might require several passes through the machine. A primary goal within the banking and currency processing industry is to sort all notes within a load according to denomination and similar face orientation in one pass. This is primarily driven by the standards of many central banks, requiring commercial banks to return to the issuing authority banknotes faced and oriented.

When stacked for loading into a currency processor, notes are either faced up or faced down. As a general rule, the preference among banks is to stack and bind notes faced the same way. Therefore, two stacks are set up for each denomination, one for face up notes and another for faced down notes. In the case of $20 bills, four stacks are usually needed (two faced up, two faced down) because of the large processing volume typical for that denomination. Therefore, for U.S. currency processing machines there may be a total of 15 collection bins (four bins for the $20 bills, two each for the other five major denominations, and one reject bin which will collect odd denominations in addition to unfit bills).

There is growing pressure within the banking industry to reduce the footprint of currency processing machines as much as possible. The easiest way to accomplish this goal is to reduce the number of collection bins. However, doing so requires that all notes within a given denomination be faced the same way within each bin stack. Doing so could reduce the number of collection bins to eight (two for $20 bills, one for each of the other five denominations, and one reject bin). There is also pressure to increase efficiency. Being able to properly face notes during processing would reduce the time required by the second pass in half.

Therefore, there is a need within the industry to have a high speed currency processing machine that can ensure all notes within each denomination are faced in the same direction during processing.

SUMMARY OF INVENTION

The present invention provides an apparatus for facing documents during high speed processing. The present invention employs at least one sensor to scan the documents individually as they are fed sequentially through a processing machine. The sensor determines the direction the documents are facing. Depending on the direction the documents are facing as determine by the sensor, a path selector directs the documents to one of two equal length paths within the processing machine. If a document is facing up, the path selector directs the document along a first path that leads directly to a collection point, such as currency sorting bins that are divided according to denomination. If a document is facing down, the path selector directs the document along a second path that includes a twisted conveyor belt which turns the document about the longitudinal axis to face up. The second path meets with the first path, wherein the conveyor belt reinserts the faced documents back into the same sequential position that the document was in relative to the other documents before being diverted by the path selector. In this manner, all of documents fed into the high speed processor arrive at the end collection point in the same order they were fed into the machine, but with all documents facing up.

BRIEF DESCRIPTION OF THE DRAWINGS

The novel features believed characteristic of the invention are set forth in the appended claims. The invention itself, however, as well as the preferred mode of use, further objectives and advantages thereof, will be best understood by reference to the following detailed description of illustrative embodiments when read in conjunction with the accompanying drawings, wherein:

DETAILED DESCRIPTION

Figure 1:
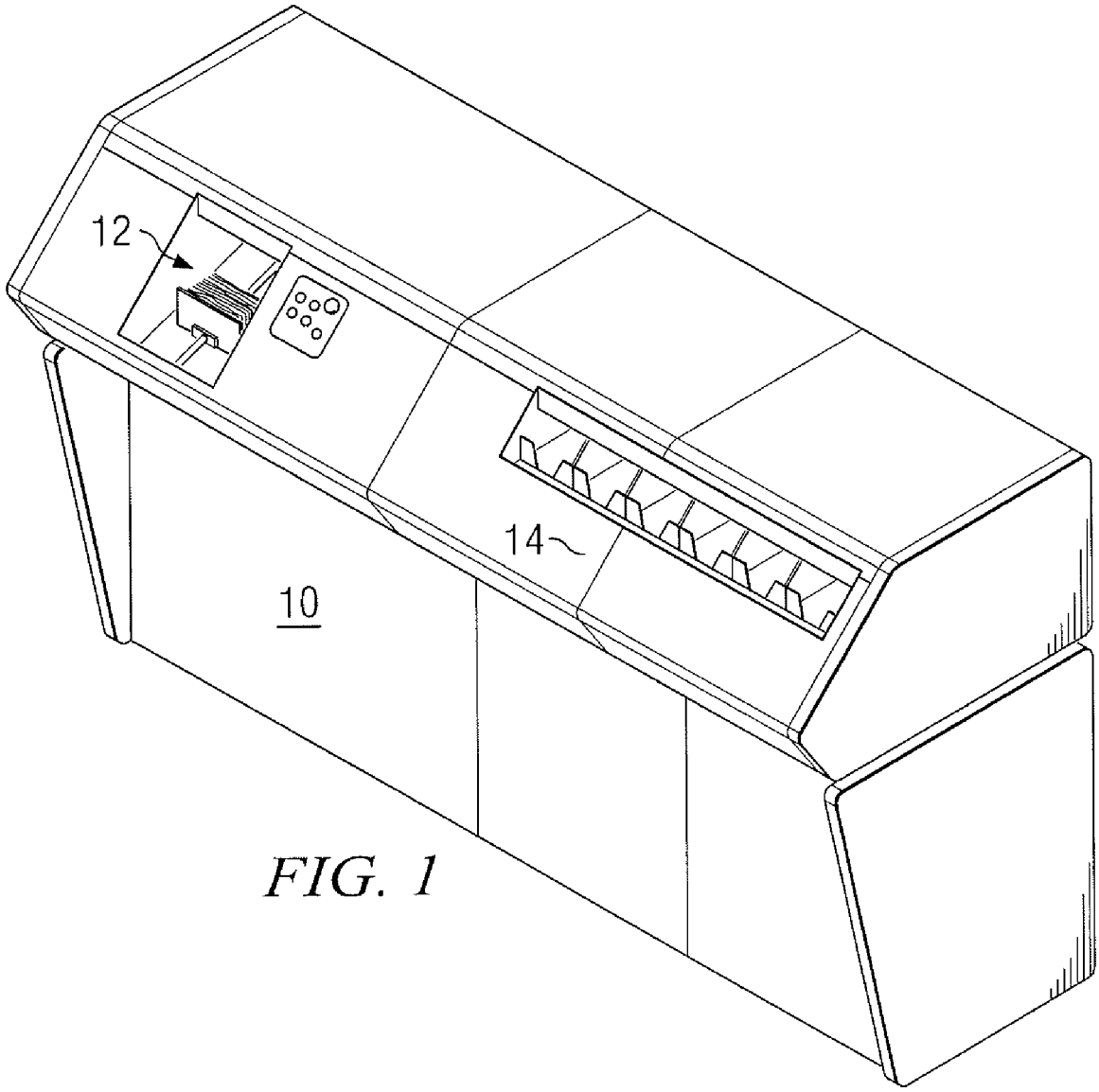
FIG. 1 shows a currency processing machine embodying the present invention and loaded with a batch feed of currency prior to starting the currency processing cycle.

FIG. 1 shows a currency processing machine 10 embodying the present invention and loaded with a batch feed of currency 12 prior to starting the currency processing cycle. This batch feed of currency 12 is fed into the currency processing machine one single note at a time. Single notes then travel on a conveyer past several different detectors before being deposited in one of the sort bins 14. Typically, a single sort bin is used to accumulate a single denomination of note at the end of the sort process.

Note facing presents several practical difficulties for high speed currency processors. Chief among these obstacles is the complexity and reliability of the physical mechanism that faces (turns) the notes.

Therefore, when notes are diverted from the main processing stream in order to be faced in the right direction, they have to be inserted back into the note stream at the same sequence position they were in before facing.

Figure 2A:
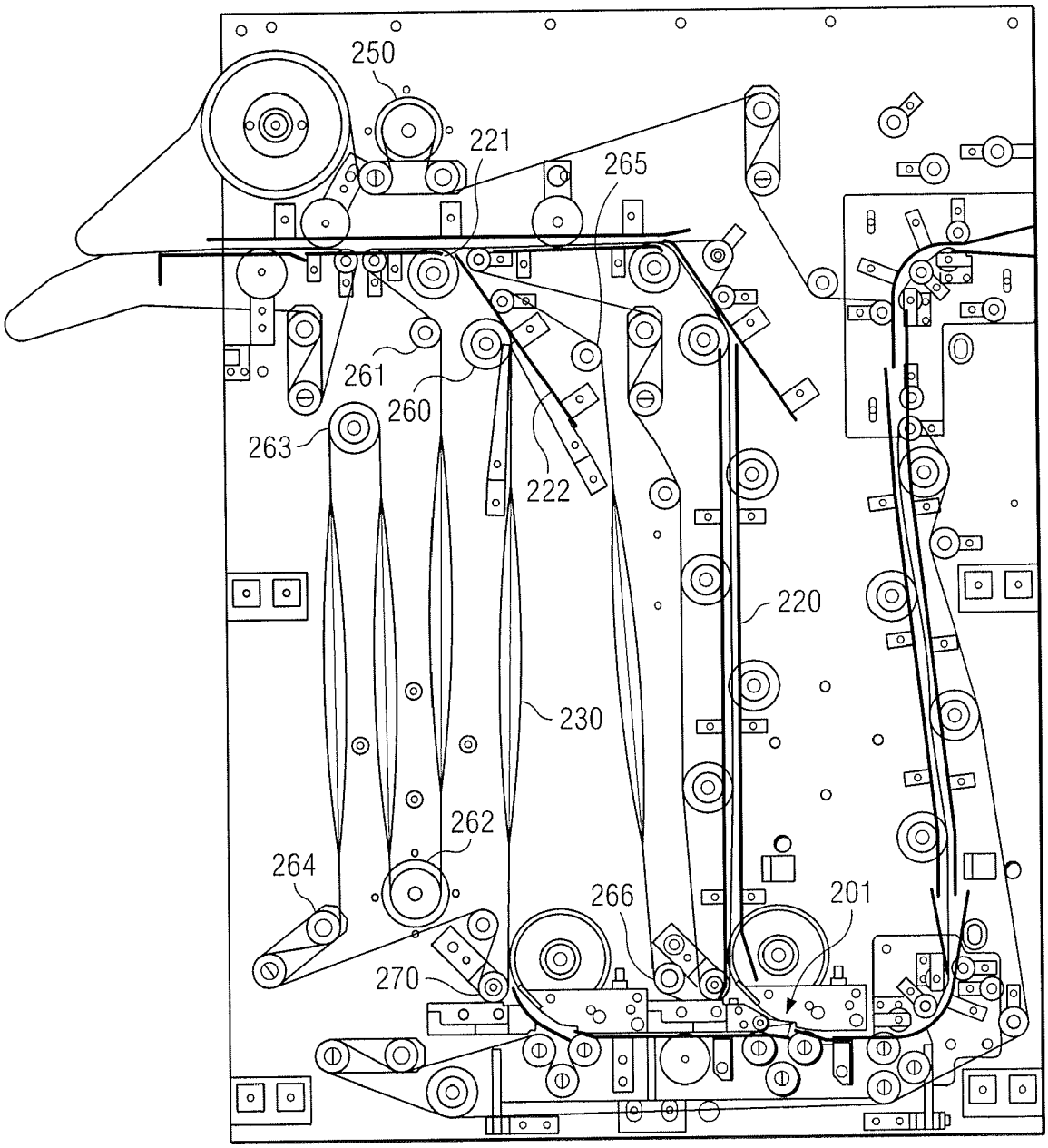
FIG. 2A shows a note facing mechanism in accordance with a preferred embodiment of the present invention.

FIG. 2A shows a note facing mechanism in accordance with a preferred embodiment of the present invention. A path selector 201 directs the path of passing notes depending on the direction they are facing. This information is determined by a camera (not shown) up the line from the path selector. Facing data collected by the camera is relayed to the controller for the path selector 201 down the line.

Figure 3A:
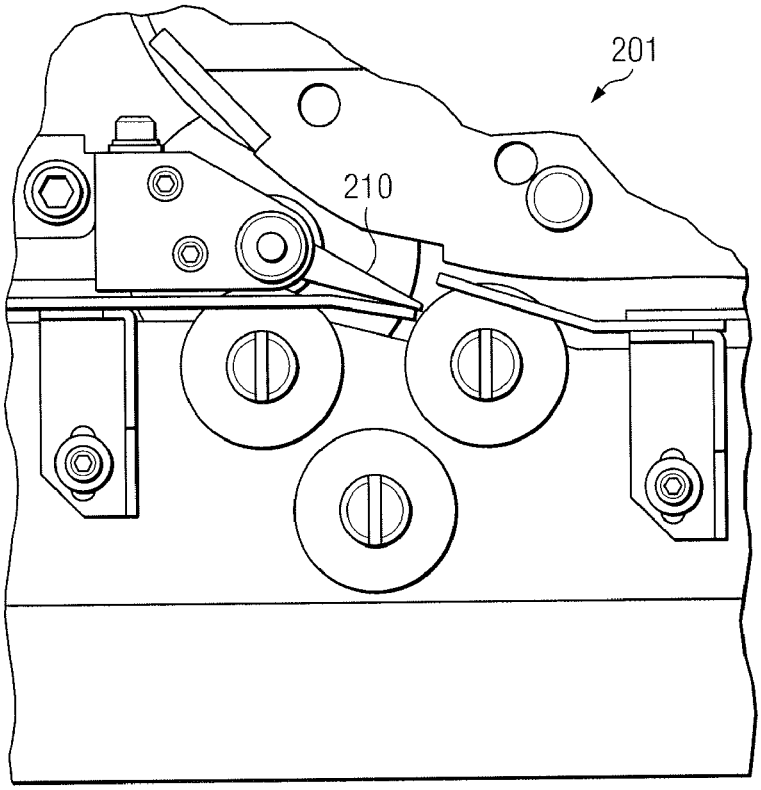
FIG. 3A shows a detailed view of the direction plate of the path selector in the down position.
Figure 3B:
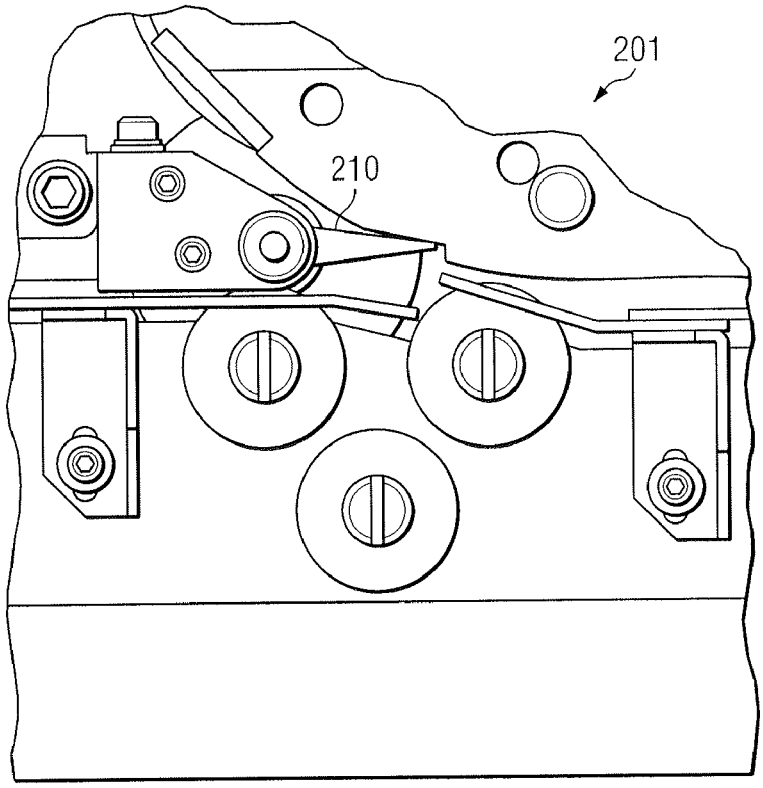
FIG. 3B shows a detailed view of the direction plate of the path selector in the up position.

The path selector has a movable direction plate 210 that moves between up and down positions, which determines the path a notes takes, similar to a rail switch on a train track. FIGS. 3A and 3B show detailed views of the direction plate 210 of the path selector 201 in the down and up position, respectively.

If a note is facing up, the direction plate 210 in moved to the down position, as shown in FIG. 3A, which opens the path to a fixed conveyor track 220 that routes the note directly to the collection bin (not show) designated for the note's respective denomination. If a note is facing down, the direction plate 210 moves to the up position, shown in FIG. 3B, which closes the path to the fixed conveyor track 220 and opens the path to the note facing mechanism.

The note facing mechanism comprises a conveyor belt 230 that is twisted to rotate notes 180° about the longitudinal axis. When a face down note is diverted to the facing mechanism by the path selector 201 it is picked up by the conveyor belt 230 and rotated to face up. Once faced up, the note is then inserted back into the currency stream at the insertion point 221 of the conveyor track 220 in the same sequence position relative to the other notes being processed.

As illustrated in FIG. 2A, these two alternate paths form a symmetrical box pattern. In order to ensure that notes faced by the facing mechanism are returned back to their proper sequence position, the distance between the path selector 201 and the currency stream reentry point 221 is the same for both the path along the fixed conveyor track 220 and the path incorporating the twisted belt 230. Therefore, face-down notes directed into the facing mechanism will reach the reentry point 221 in the same amount of time as they would if they had traveled along the fixed track 220, allowing them to maintain their sequence position relative to the other notes in the processing batch despite the diversion through the facing mechanism.

Because of the short distance over which the notes have to be turned, it is impractical to put a complete 360° turn in the conveyor belt within a single loop around two rollers. Doing so over such a short distance would wind the belt too tightly, creating potential tracking problems for the belt. To deal with the short distance over which the notes are faced, the twist in the conveyor belt is distributed over several turns around the rollers in order avoid the need for a tight 360° twist.

The facing belt 230 is twisted into a FIG. 8 when mounted onto the rollers. As illustrated in the FIG. 2A, the note-facing conveyor belt 230 makes a quarter twist between the feed point 270 from the path selector 201 and the reinsertion point 221 of the notes back into the processing sequence. The belt 230 is doubled upon itself between the feed point 270 and the top roller 260 near the reinsertion point 221. This doubling is due to the overlap from the FIG. 8, allowing the belt to carry notes from the feed point 270 to the reinsertion point 221.

When the belt 230 reaches the slanted guide rail 222 adjacent to roller 260, the belt 230 diverges to the left and right as the overlap section of the FIG. 8 ends. The leftward segment of the belt 230 follows the slanted guide rail 222 up to the reinsertion point 221. The rightward segment of the belt 230 makes a quarter turn between roller 265 and roller 266 at the bottom of the plate near the path selector 201.

After passing the reinsertion point 221, the leftward segment of the belt 230 returns toward the bottom of the plate and makes a quarter twist as it moves between rollers 261 and 262. The belt path then reverses direction again, and the belt 230 makes another quarter twist as it moves between rollers 262 and 263. The belt 230 makes its last quarter twist between guide rollers 263 and 264 before returning to the feed point 270.

The multiple quarter twists made by the conveyor belt 230 as it winds between the rollers 260-266 allows the FIG. 8 in the belt to be wound and unwound gradually over the belt's circuit, without the tight twist and potential tracking problems noted above.

Figure 2B:
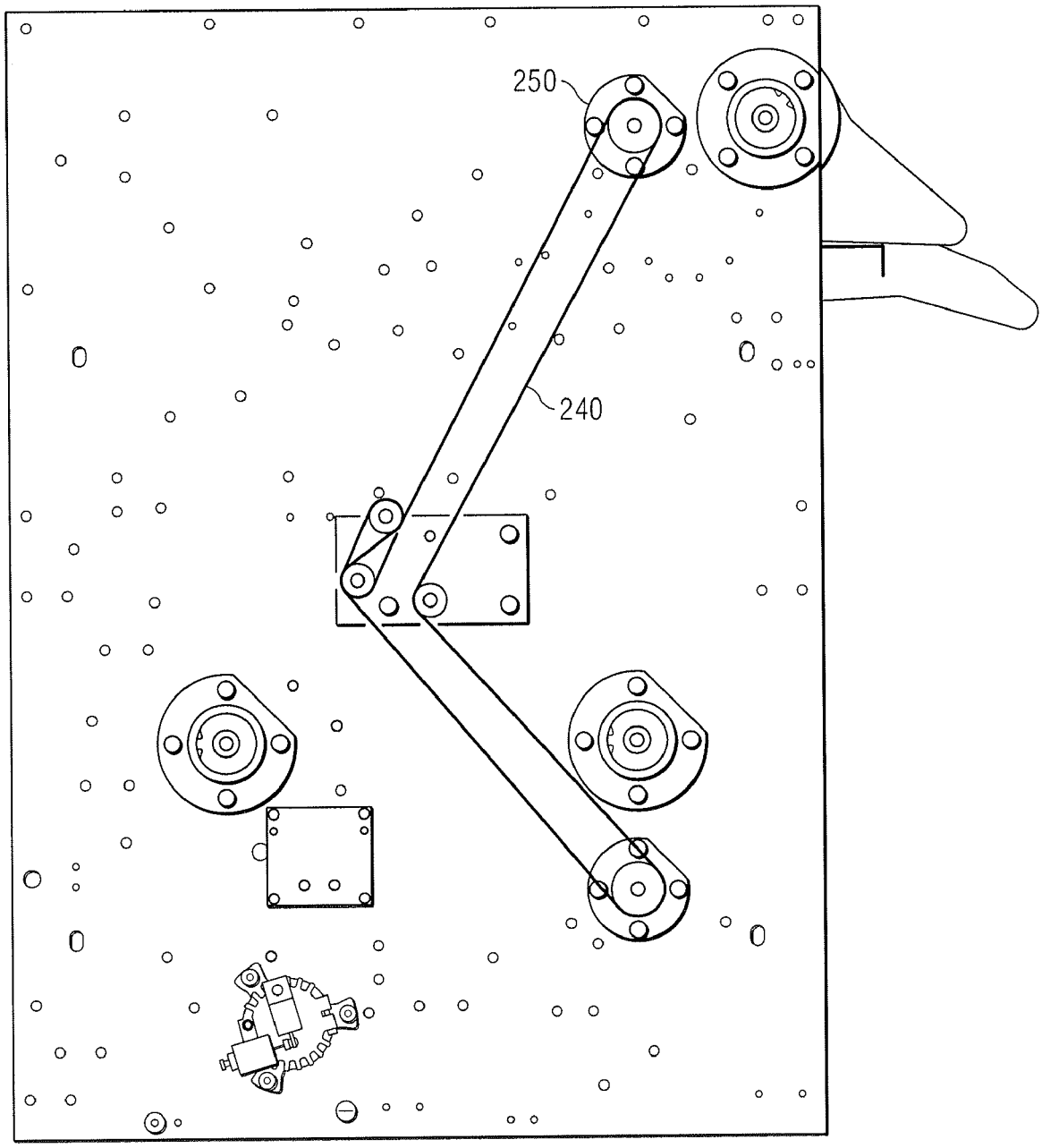
FIG. 2B shows the underside of the plate on which the facing mechanism is mounted in accordance with a preferred embodiment of the present invention.

FIG. 2B shows the underside of the plate on which the facing mechanism is mounted in accordance with a preferred embodiment of the present invention. The twisted conveyor belt 230 of the note facing mechanism is directly driven by a separate drive belt 240, which is spun off drive 250 that drives the primary conveyor track. Due to space restrictions, the drive belt 240 for the facing mechanism is mounted underneath the plate, as illustrated in FIG. 2B.

In conventional currency processors, all of the notes follow the same path through the processor until they are diverted into their respective denomination bins or reject bins near the end of the processing track. In such a configuration, the conveyors along the path may be driven by a single motor, wherein drive torque is transferred from one conveyor to the next. However, this drive configuration will not work with the present invention due to slight marginal losses in torque, and hence speed, from one conveyor to the next. The marginal loss in conveyor speed from attempting to drive the twisted belt 230 indirectly using the primary conveyor track is too much to ensure that the faced notes will be consistently inserted back into their proper sequential position within the currency processing path. This is largely due to high processing speeds of up to 2,000 notes per minute.

Driving the twisted belt 230 directly off drive 250 via belt 240 maintains the necessary speed of the twisted conveyor belt 230 to ensure that notes fed into the facing mechanism are consistently reinserted back into the primary note stream in their original sequential position.

Figure 4:
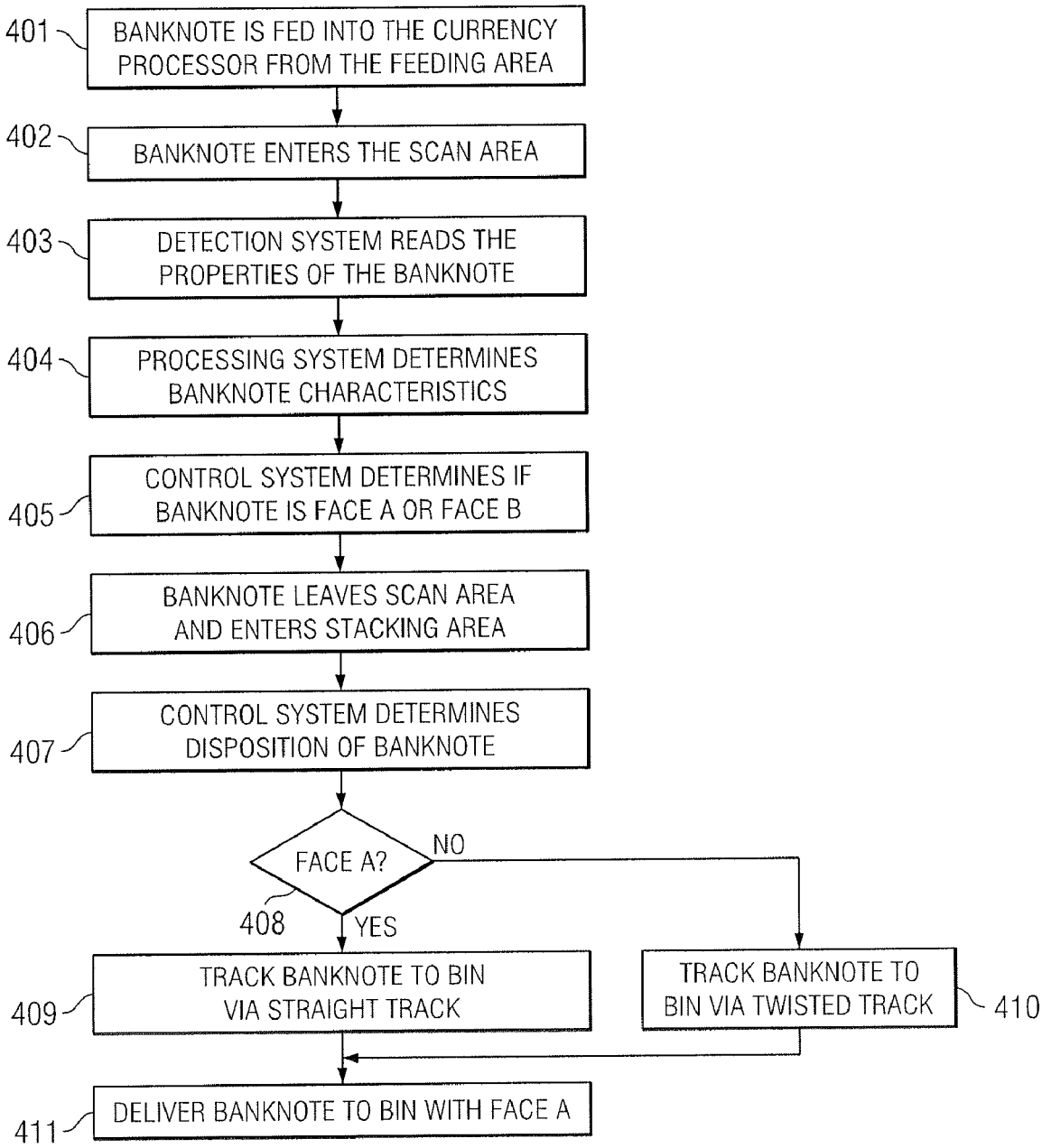
FIG. 4 shows the process flow of the overall operation of the facing mechanism in accordance with the preferred embodiment of the present invention.

FIG. 4 shows the process flow of the overall operation of the facing mechanism in accordance with the preferred embodiment of the present invention. The process begins when a banknote if fed into the currency processor from the feeding area (step 401). Typically, the banknote will be part of a stack of banknotes.

After the banknote is fed into the sorting system it enters the scan area (step 402). In the scan area a computer based detection system uses one or more sensors (e.g., line scan cameras) to read the properties of the note (step 403). From the data collected by the detection system, the processing system determines banknote characteristics including, but not limited to, currency denomination, orientation, fitness, and authenticity (step 404).

The control system also determines which way the note is faced, side A or B (step 405). What constitutes A and B is arbitrary. Using U.S. currency as an example, side A may be the side featuring the face portrait.

The banknote then leaves the scan area of the processor and enters the stacking area (step 406). The control system determines the disposition of the note (step 407). This disposition refers to the sorting bin or pocket into which the note will be directed, which is typically determined by the note's denomination.

After the control system determines the note's disposition, it directs the note through one of two paths depending on which way the note is faced, A or B (step 408). If the banknote is faced A, the control system tracks the note to the final destination (collection pocket) via the straight conveyor track (step 409). If the note is faced B, the control system tracks it to the destination via the twisted track described above (step 410).

The final result is that regardless of how the banknote was faced when it entered the sorting machine, it is delivered to the destination pocket faced A (step 411). The choice of which face is preferred, A or B, is arbitrary. The essential point is that bank notes will all be delivered to the final collection pockets faced the same way, regardless of how they were faced when initially fed into the sorting system.

The present invention ensures that all notes within each denomination are faced in the same direction during processing. Applied to U.S. currency processing machines, for example, the invention allows the number of collection bins to be reduced to eight (two for $20 bills, one for each of the other five denominations, and one reject bin), thereby minimizing the footprint of the processor.

In an alternate embodiment of the present invention, multiple note facing modules can be cascaded in order to allow notes of different sizes to be faced by the same currency processor. This is particularly useful for large commercial banks that routinely process multiple currencies. Because the physical dimensions can change between currencies, the facing mechanism has to be configured slightly differently for each currency of similar size.

For example, British Pound notes are wider than U.S. Federal Reserve notes. As such, the twisted conveyor belt used to face the pounds would have to be slightly higher off the surface of the plate in order provide enough clearance for the pound notes as they are being rotated by the belt. Furthermore, the facing belt itself may also be wider to facilitate better control over the wider pound notes.

By using multiple facing modules within a single currency processor, a bank can accommodate multiple currencies without the need for a separate processor for each national currency.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the appended claims.

What is claimed is:

1. An apparatus for facing documents during high speed processing, comprising:

(a) at least one sensor that scans a plurality of documents individually as they are fed sequentially through a processing machine, wherein the sensor determines the direction the documents are facing; and (b) a path selector that directs said documents to one of two equal distance paths within the processing machine, depending on the direction the documents are facing, wherein:

(i) if a document is facing up, the path selector directs the document along a first path that leads directly to a collection point; and (ii) if a document is facing down, the path selector directs the document along a second path, wherein the document is turned to face up, wherein said second path meets with said first path, wherein a document directed into said second path is placed back into the same sequential position that said document was in relative to the other documents before being diverted by the path selector to said second path; and (c) a twisted conveyor belt along said second path that turns the document about its longitudinal axis to face up wherein said belt is folded into a figure 8 pattern, wherein documents are held between sections of the belt that overlap at the crossover of the figure 8 and said overlap section is twisted 180° between a first roller and a second roller, thereby allowing the belt to turn the documents, and wherein four additional 180° twists are placed in said belt as the belt moves through a complete circuit around a plurality of rollers, wherein said four additional 180° twists complete the twist in the belt allowing the figure 8 to be wound and unwound over the belt's circuit.

2. The document facing apparatus according to claim 1, wherein said twisted conveyor belt is independently driven.

3. The document facing apparatus according to claim 1, wherein multiple said facing apparatuses may be combined within a single document processing machine, wherein each facing apparatus faces a different sized document.

4. The document facing apparatus according to claim 1, wherein the apparatus can process up to 2,000 documents per minute.

5. A method for facing documents during high speed processing, comprising the steps of:

(a) feeding a plurality of documents into a document processing machine;

(b) scanning said plurality of documents individually as they are fed sequentially through a processing machine and determining the direction the documents are facing; and (c) directing said documents into one of two equal distance paths within the processing machine, depending on the direction the documents are facing, wherein:

(i) if a document is facing up, directing the document along a first path that leads directly to a collection point; and (ii) if a document is facing down, directing the document along a second path, wherein the document is turned to face up, wherein said second path meets with said first path, wherein a document directed into said second path is placed back into the same sequential position that said document was in relative to the other documents before being diverted by the path selector to said second path; and (d) wherein the step of turning documents to face up is performed by a twisted conveyor belt along said second path that turns the document about its longitudinal axis, wherein said belt is folded into a figure 8 pattern, wherein documents are held between sections of the belt that overlap at the crossover of the figure 8 and said overlap section is twisted 180° between a first roller and a second roller, thereby allowing the belt to turn the documents, and wherein four additional 180° twists are placed in said belt as the belt moves through a complete circuit around a plurality of rollers, wherein said four additional 180° twists complete the twist in the belt allowing the figure 8 to be wound and unwound over the belt's circuit.

6. The method according to claim 5, further comprising driving said twisted conveyor belt independently.

7. The method according to claim 5, further comprising combining multiple facing apparatuses within a single document processing machine, wherein each facing apparatus faces a different sized document.

8. The method according to claim 5, further comprising processing up to 2,000 documents per minute.

* * * * *